United States Patent [19]

Mikkelsen, deceased

[11] 3,933,103

[45] Jan. 20, 1976

[54] SLUICE FOR COMBUSTION FURNACES AS ROTARY KILNS

[75] Inventor: Verner Johannes Mikkelsen, deceased, late of Kastrup, Denmark, by Aase Foght Mikkelsen, executrix

[73] Assignee: Aktieselskabet "Volund", Glostrup, Denmark

[22] Filed: Mar. 13, 1974

[21] Appl. No.: 450,805

[30] Foreign Application Priority Data

Mar. 14, 1973 Denmark ..... 1383/73

[52] U.S. Cl. ..... 110/165 R; 110/171; 214/17 A

[51] Int. Cl.[2] ..... F23J 1/00

[58] Field of Search ..... 110/165, 171; 214/17 R, 214/17 A, 18 R, 35 R

[56] References Cited

UNITED STATES PATENTS

| | | | |
|---|---|---|---|
| 1,595,957 | 8/1926 | Allen | 214/17 |
| 1,809,501 | 6/1931 | Allen | 110/171 |
| 2,626,066 | 1/1953 | Rasmussen | 214/17 |
| 2,693,775 | 11/1954 | Berry | 110/165 |
| 2,834,665 | 5/1958 | Rudolph et al. | 110/165 X |

*Primary Examiner*—Kenneth W. Sprague

*Attorney, Agent, or Firm*—Pennie & Edmonds

[57] ABSTRACT

A sluice arrangement for sluicing out clinker and uncombusted residue from combustion furnaces such as rotary kilns and the like. A steel plate duct having a cross-section at least equal to that of an ash pit is attached to the lower end of the ash pit in a downwards steeply slanting position and is provided with an upper and lower mechanically operated swinging flap. By manually or automatically controlling the closed/opened positions of the flaps relative to each other an effective sluice is provided. A pilot system for the sluice wherein the motive power for operation of each of the flaps is controlled by separate changeover devices is also provided wherein the changing over effects the required closing/opening sequence of the flaps to provide an effective sluice.

20 Claims, 4 Drawing Figures

SLUICE FOR COMBUSTION FURNACES AS ROTARY KILNS

BACKGROUND OF THE INVENTION

1. Field of the Invention

The invention relates to a sluice arrangement for the sluicing out of clinker and uncombusted residue from combustion furnaces, i.e. the residual material which is discharged from the discharge end of a fuel-transporting grate, or from a rotary kiln.

The arrangement is well suited for furnaces fired with poor solid fuels, especially incinerator furnaces for household refuse, but may be used for any furnace where clinker and slags are discharged.

2. Description of the Prior Art

In one-furnace plants, the material in question usually is discharged either directly to a clinker or ash pit, or to conveyor means, transporting the material to the clinker or ash pit.

In multi-furnace plants, there may be separate clinker or ash pits for each furnace, or the material may fall onto conveyor means which discharge the material into a common clinker or ash pit.

The arrangement according to the invention is usable in one-furnace as well as multi-furnace plants at the place where the hot residual material discharged from one or more furnaces is transferred to the store which it is sooner or later removed from the plant.

From the prior art it is known to sluice out the residual matter, such as slags and clinker, through a siphon trap. The discharged material flows through a shaft, the end of which dips down under the water surface in a water-filled basin; the material is cooled through contact with the water and then settles on the bottom of the basin from where it is removed by suitable conveyor means such as a scraper conveyor.

This system has the advantage of ensuring an effective cooling of the discharge uncombusted material and providing for an effective seal, preventing false draught to the flue gas ducts. However, the erection as well as the operation costs are rather high. Also, it is rather water-consuming and difficult to repair during operation. Moreover, fine particles contained in the discharged material or split off from layer clinker dropping into the water may collect as a slurry-like mass on the surface of the water, from where it must be removed, and the conveyor means are subject to heavy wear.

It is also known to perform the sluicing-out without the use of a water trap, for instance by means of a screw conveyor mounted in a tube-formed guide, or by a system of push-pistons, pushed along a duct which has its base in the side wall of the ash pit, near the bottom, and whose cross section is the same as that of the pistons. These conveyor means can, however, hardly stand temperatures as high as 900°–1000°C which may well be reached, and by this known dry-sluicing it is furthermore difficult, or impossible, to attain a sufficient degree of tightness, which may unintentionally cause false draught through the ash pit to the flue ducts.

In instances in which the material which has fallen down in the pit contains voluminous elements such as scrap, which is common occurrence in incinerator plants for household refuse and the like, none of the above sluicing-out systems are suited, as such parts either cannot be sluiced away in the manner described, or will entail great risks of the system being jammed or damaged.

It is a purpose of the invention to procure a sluicing-out arrangement of the kind described in the preamble, and moreover an arrangement which does not have the defects outlined above, which can be installed at relatively low costs, and which permits a safe and particularly advantageous operation.

Furthermore, the invention includes a method for the operation of the above-mentioned arrangement and a pilot system for automatic control of the arrangement during this operation.

SUMMARY OF THE INVENTION

In the following text, the term "ash pit" has been used to name the shaft through which the uncombusted material leaves the proper furnace, be it either directly from the grate or a rotary kiln or after having been conveyed in the hot state to be discharged at a far remote place.

According to the invention, the arrangement comprises a steel plate duct having a cross section at least equal to that of the ash pit, being attached to the lower end of the ash pit in a downwards steeply slanting position, and being equipped with an upper and a lower mechanically operated swinging flap, the flaps in their closed positions forming a sluicing chamber within the duct, and in their open positions exposing the full cross section of the duct; in the side walls of the duct nozzles being mounted between the two flaps for spraying water into the sluicing chamber; a discontinuously working transport bucket being arranged for directly beneath the lower rim of the duct for chargewise removal of material discharged from the duct.

The arrangement according to the invention has been built on the well-known principle of a chamber sluice with two sluice gates. The arrangement thus offers the advantages of this system in the form of tightness during the sluicing out operation. By the application in question, it furthermore provides for the possibility of procuring — when desired — an unimpeded flow of fresh air up through the ash pit and into the furnace in a simple way, viz. by opening both gates.

By means of a limited quantity of water sprayed through the nozzles, the uncombusted material is cooled effectively, and present or developing dust laid, so that the sluiced-out material does not contain any great surplus of water and can be moved to a bin or pile in a correspondingly cleanly way.

In the operation step of the arrangement, the upper gate will be open and the lower one closed, so that the material discharged falls through the ash pit and down on the lower gate. After a certain time the next steps follow, whereby the upper gate is closed then the lower one is opened whereby the material contained in the sluice chamber will fall down in the conveyor means arranged below for further transport. During these two steps the material which has fallen down into the ash pit is held back by the closed, upper gate. After the emptying of the sluicing chamber, the lower gate is again closed and the upper one opened, and the cycle just described is repeated.

During normal operation of the furnace, it is important that only one of the gates or flaps is open at a time. Furthermore, it should only be possible to open the lower gate or flap for emptying when the conveyor bucket is placed directly under the discharge opening. According to this, the movement of the gates or flaps of the sluice chamber may, according to the invention, be controlled in such a way that one gate or flap cannot be opened without the other being closed, and the the lower one is only opened when the conveyor bucket is placed in its receiving position. This compulsory control of the movements of the gates or flaps may, of course, be abolished when it is desired that both of them should be opened to make a draught up through the ash pit; and according to the invention, the interdependence of movement may be abolished in such a way that both gates may be kept open at the same time and independent of the position of the transport bucket.

In order for instance to avoid damage to the parts working during the operating of the gate, especially in the case of refuse incineration where possibly heavy lumps of refuse during their fall may hit the gates, for instance during the opening/closing movements of the latter, this movement can according to the invention be carried out in a way know per se, by pneumatic means so that the effect of the possible impact is caught elastically. The use of pneumatic means entails the advantage that operation stops are avoided in the case of possible brief compressor stops due to the fact that the compressed-air receiver connected to the compressor acts as accumulator for the air compressed by the compressor.

The system according to the invention gives optimum safeguarding against the penetration of false air to the flue ducts of the furnace. Furthermore it makes it possible to work with a minimum consumption of water for cooling down uncombusted material and laying the dust which, in its turn, gives minimum pollution of buildings and sewer outfalls and makes it possible to feed a maximum quantity of air to the flue ducts of the furnace through the ash pit when this is desirable, for instance in case of priming of the boiler. The operation costs are small due to the small amount of movable components and the fact that they are relatively lightly loaded.

By a preferred operation method for the system, the lower flap is, according to the invention, closed, and the upper one open during a certain fill-up period, such as 5–15 minutes, during which time a comparatively small quantity of water is sprayed into the sluice chamber through the nozzles to lay the dust and keep the nozzles clean, whereas the transport bucket before the end of this period is brought to its receiving position under the discharge opening of the sluice. Thereafter the upper flap is closed and during a cooling period of for instance 1–2 minutes, a greatly increased quantity of water corresponding to the cooling of the slags to about 200°C, is sprayed into the sluice chamber. After this cooling period, the increased water feeding is stopped and the lower flap is opened and is kept open during a period of discharge, such as half a minute, whereupon after discharge into the transport bucket it is closed again and the upper flap is opened, and the bucket with the discharged material is removed. The procedure is then repeated. Furthermore, both flaps may be kept open at the same time without considering the above-mentioned functional interdependency, if required for instance in the case of priming of the boiler.

The above procedure is preferably controlled automatically by means of a suitable pilot system governing the movement of the movable parts, dependent on pre-selected periods and signals indicating the operational state of the incinerator.

Such a pilot system for a sluice system, in which the motive power for the operation of each of the flaps is controlled by a separate change-over device which by changing over effects the closing/opening respectively of the flaps, may according to the invention be arranged in such a way that the change-over devices for the motive power are governed by signal emitters which latter are actuated by the open/closed position of the flaps respectively and activate electric switches so that they, dependent on a signal from a signal emitter which in its turn is activated by the transport bucket in its receiving position, activate time relays to effect a switch of the above-mentioned change-over devices, and opening/closing respectively of the water feed to the sluice chamber in the working cycle as stated by the procedure.

According to the invention, such a pilot system may be connected to a mechanism effecting a compulsory action by the change-over devices, so that both flaps are swung in open position, which mechanism goes into action in the case of abnormal conditions, such as priming of a boiler in the furnace.

Further, the pilot system may, according to the invention contain an alarm mechanism, know per se and reacting on abnormal incidents in the control system.

A preferred embodiment of a pilot system according to the invention, serving the above pilot functions, is described in the specification below, and its different characteristics are listed in the claims.

BRIEF DESCRIPTION OF THE DRAWINGS

The invention will be further elucidated below where an embodiment of a sluice system according to the invention and the appurtenant pilot system have been described with reference to the drawing where.

DESCRIPTION OF THE PREFERRED EMBODIMENTS

Figure 2:
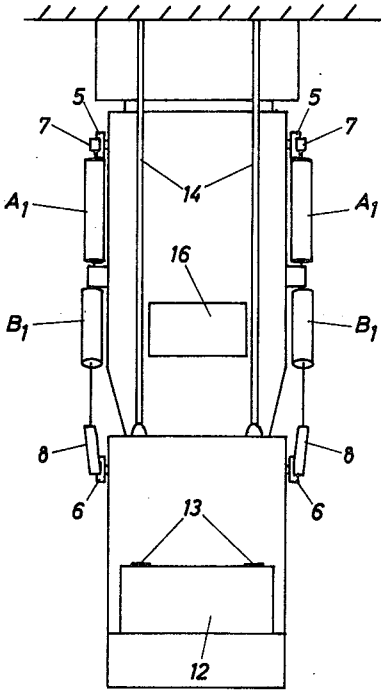
FIG. 2 the system — as seen from the left in FIG. 1.

The lower end of the end of the shaft 1 is provided with a knee section 2, made of steel plate, preferably with a lining of special wear-resistant cast iron plates.

The lower part of the knee section 2 ends within the upper part of a slanting duct 3, forming the sluice chamber.

The duct 3 is rectangular in cross section and made of steel plate and lined with wear-resistant cast iron plates. The downward facing side of the duct 3 is plane, and the lower end of the duct has an approximately even cross section. From about the middle of the duct, its cross section has been enlarged, giving space for a flap A, mounted on a swinging axle 5. The latter is supported in not shown bearings, arranged on each side of the side walls of the duct 3 at its top, and moreover positioned in such a way that the flap can swing either clockwise to a position — shown in dotted line — in the enlarged portion of duct 3, or counter-clockwise to a position — shown in full line — where it closes the mouth of knee section 2.

The duct 3 opens into a hopper 4, at the top of which is arranged a flap B similar to the way in which flap A has been mounted. Flap B is mounted on a swinging axle 6, carried by not shown bearings on each side of the hopper 4. Flap B can be swung either clockwise to the position shown in dotted line, or counter-clockwise to the position shown in full line, where it closes the month of the duct 3.

The movements of the two flaps A and B are brought about by two pneumatic cylinders $A_1$ and $B_1$ respectively, the piston of cylinder $A_1$ being hingedly connected to an arm 7 fixed to and extending from the axle 5, and the piston of cylinder $B_1$ being hingedly connected to an arm 8 fixed to and extending from the axle 6.

Below the sluice arrangement just described, a skip hoist 9 is provided with a bucket 11 running on rails 10. The bucket is shown in its end position ready to receive clinkers and the like residue discharged from the hopper 4. The bucket 11 and the rails 10 are so mounted that the upper rim of the bucket is almost level with the lower rim of the hopper. Thereby the risk that dust originating from the clinker and residue should spread and stir up from the bucket during the discharge operations is considerably minimized. To avoid the risk that residues, such as large clinker, not molten and partly molten metal parts, projecting above the rim of the bucket, should catch the wall of the hopper and be jammed, thereby damaging the hopper or the bucket or both, the lower portion 12 of the hopper wall facing the travelling direction of the filled bucket is formed as a swing flap connected at its upper edge to the upper part of said wall to its lower edge.

The sluicing arrangement, comprising the knee section 2, the duct 3 with flat A, the hopper 4 with flap B and the pneumatic cylinders $A_1$ and $B_1$ fixed to the upper wall of the duct 3, is suspended from the end of the shaft 1 and the furnace base in the following way. The upper end of knee section 2 is provided with a flange which is fastened to the brickwork of shaft 1 by vertical bolts. The knee section 2 is connected to the duct 3, which again is connected to the hopper 4, so that the parts then form a unit. The hopper 4, moreover, is carried by adjustable suspension rods 14.

In the side walls of the sluice chamber, i.e. the duct 3, nozzles 15 are provided through which water is sprayed over the contents of the chamber.

In the upper wall of the duct a tight fitting inspection door 16 is provided.

Figure 1:
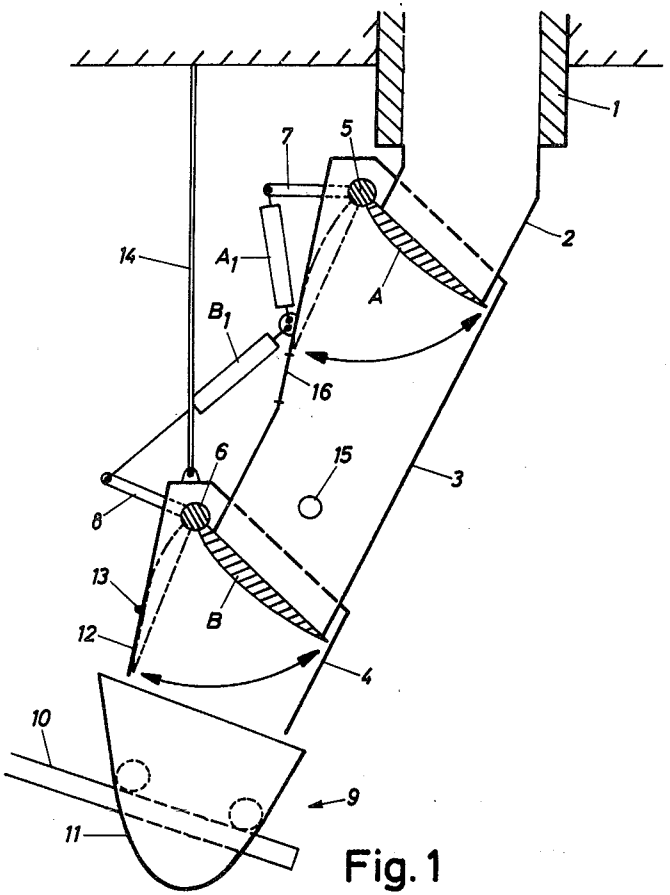
FIG. 1 represents the sluice arrangement proper, in longitudinal section.
Figure 4:
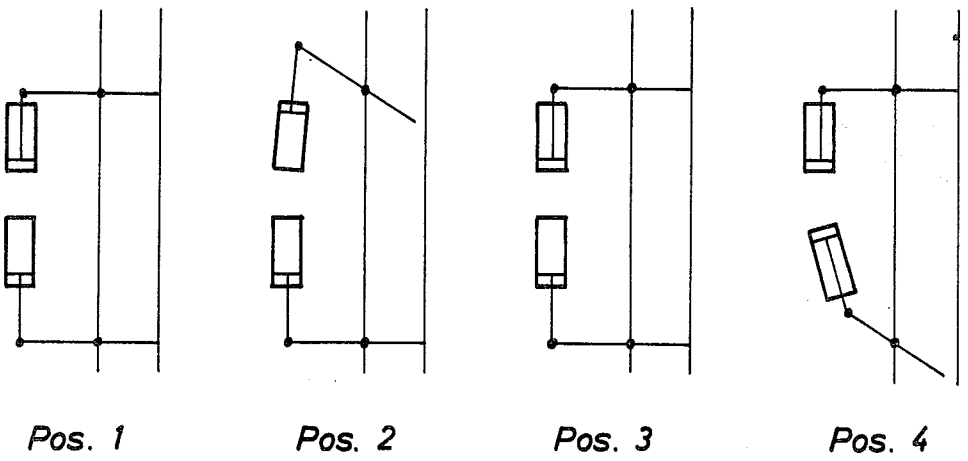
FIG. 4 a diagram of the positions of the sluice gates in the course of a working cycle.

The operation of the sluice system is cyclic and has four steps as shown in FIG. 4, viz. step 1: both of the flaps A and B closed; step 2: upper flap A open, lower flap B closed; step 3: both flaps A and B closed; and step 4: upper flat A closed and the lower flap B open. Thus the positions of the flaps, as shown in FIG. 1 in line, correspond to the 1st or 3rd step. During step 1 the clinker and residue from the combustion falling down through shaft 1 collect in the knee section 2.

During step 2 the collected material falls down into the sluicing chamber, i.e. the duct 3.

During step 3 the quantity of water sprayed through the nozzles is considerably increased with the effect that the clinker and residue now resting in the sluicing chamber is properly cooled down.

During the entire cycle, a minimum quantity of water is fed to the water nozzles by means of an adjustment valve, the said quantity of water being just sufficient to lay the dust and keep the nozzles free of clogging by ashes and clinker dust.

The transition from one step to the next one is performed by operating adjustment valves controlling the introduction of compressed air to the cylinders $A_1$ and $B_1$ respectively. This adjustment is made by means of air pilot, the flow of which is controlled by a valve which is activated by the position of the pistons in the cylinders, and by signals from electric relays respectively. Also the supply of additional water to the nozzles in the sluice chamber is controlled by air pilot.

Figure 3:
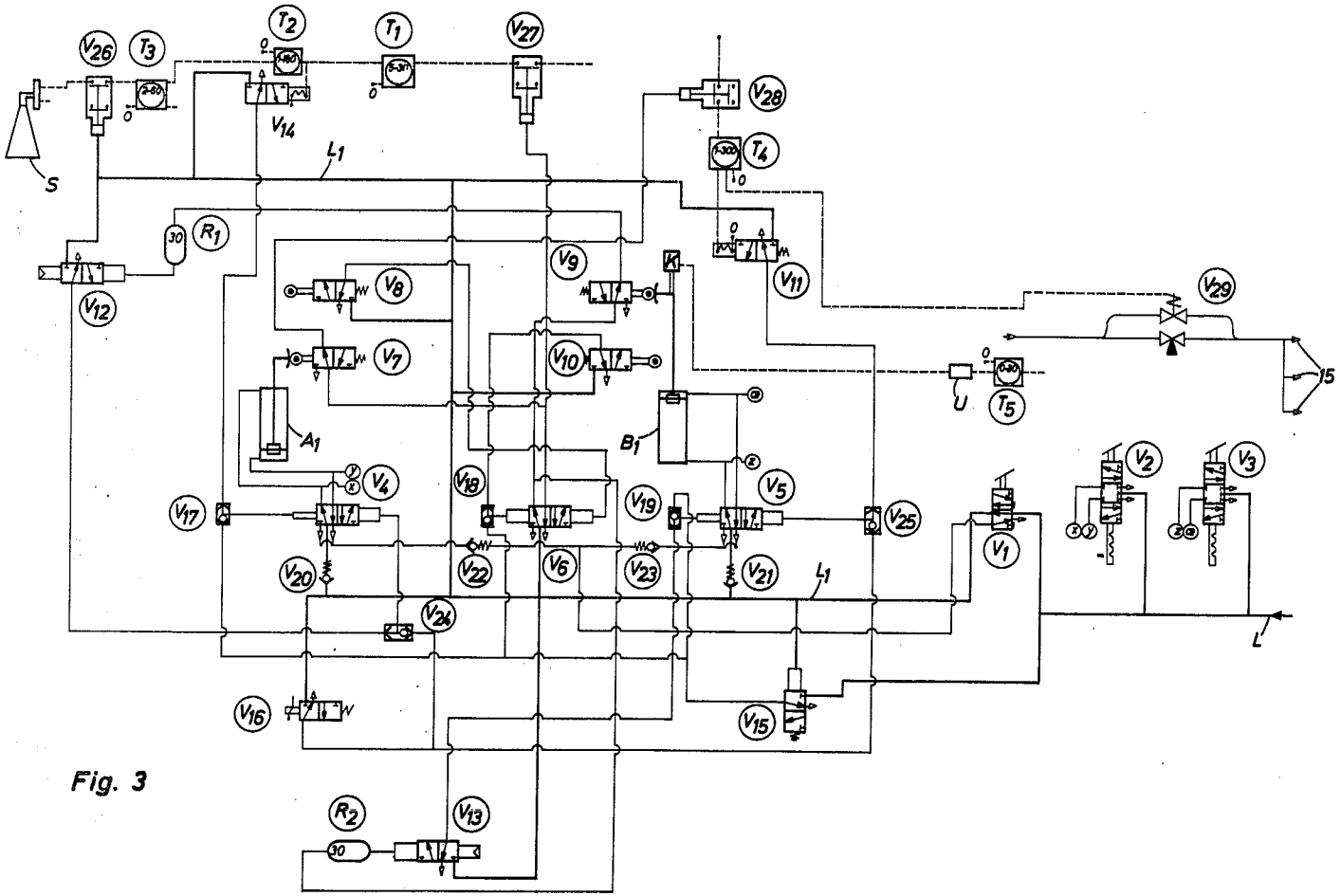
FIG. 3 a diagram of the automatic pilot system.

In a diagram in FIG. 3 is shown a pilot system (certain parts being left out) for automatic control of the sluicing arrangement. The system may be switched over to manual operation. In the diagram the shown positions of the pistons in the two cylinders $A_1$ and $B_1$ correspond to step 1. This step follows step 4, the discharge operation, at the end of which the lower flap is closed and step 1 — as shown — comes into play, being maintained for only a short time before under step 2, the upper flap A is opened.

As motive power is used compressed air entering through feed pipe L and flowing to a manually operated two-way valve $V_1$, adjustable either to manual or automatic operating position. Valve $V_1$ is shown adjusted to automatic operation and allows compressed air to the main piping of the system $L_1$, shown in bold line. From the system $L_1$ the compressed air can flow to the distribution pipes shown in fine line, according to the position of the various valves described in detail below.

The upper sluice flap A, and the lower one B, are moved for opening and closing separately by a pneumatic working cylinder $A_1$ respectively $B_1$, whose functions are reversed by reversing valves $V_4$ and $V_5$ respectively, which are pneumatically operated and each adapted to make connection between a feed line and one or the other end of the cylinder, at the same time airing the other end of the cylinder. When the sluice flap A is in closed, respectively open position, the flap will engage the change-over valve $V_7$, respectively $V_8$, forcing it against a spring load, which returns the valve when the flap's position is changed.

In the same way flap B cooperates with similar valves $V_9$ and $V_{10}$.

In their two positions, the above-mentioned change-over valves are adapted to connect a feed and discharge line, respectively close the feed line and air the discharge line.

A pneumatically adjustable change-over valve $V_6$ which is built like the change-over valves $V_4$ and $V_5$, connects a feed line with either the change-over valve $V_9$ or a pneumatically operated electric switch $V_{27}$.

In various places in the main line net and the distribution line net for the compressed air single-acting non-return valves $V_{20}$, $V_{21}$, $V_{22}$ and $V_{23}$ and double-acting non-return valves $V_{17}$, $V_{18}$, $V_{19}$ and $V_{25}$ with T-junctions have been inserted. Other valves and instruments belonging to the system will be mentioned in connection with the following description of the functions of the system during a full cycle of movement of the sluice flaps, the different positions of which during such a cycle appear from FIG. 4, as mentioned above.

Prior to the change-over from position 4 to position 1, where the lower flap B was open and $V_{10}$ activated, a compressed air impulse passed through $V_{10}$ and $V_{18}$ to $V_6$ which thereby was forced left to the position shown, its left end having been aired through $V_8$. When B closes, and A is still closed as shown, both flaps are in position 1 (FIG. 4) and $V_9$ is activated by flap B. A compressed air impulse then passed from the main line through $V_6$ and $V_9$ to a delay air receiver $R_1$ and further to a spring-loaded, pneumatic change-over valve $V_{12}$. When the pressure has been built up in $R_1$ with a delay of say 30 seconds $V_{12}$ will react and permit a compressed air impulse to pass on to $V_{24}$ and then to the change-over valve $V_4$ which changes over thereby allowing air from the main line to the bottom of cylinder $A_1$ with the effect that flap A will open, the other end of valve $V_4$ having been aired through $V_{17}$ and a spring-loaded change-over valve $V_{14}$.

When thus the upper flap A is opened, whereby $V_8$ is activated, the flaps are in position 2. Generally speaking it is so that the working cylinders $A_1$ and $B_1$ when being changed over are aired through $V_{22}$ and $V_{23}$ respectively, and by the change-over valve $V_1$ when this valve is adjusted for automatic operation.

Through the now activated change-over valve $V_8$ a compressed air impulse passes to $V_6$ which changes over whereby the air receiver $R_1$ and a similar air receiver $R_2$, inserted before a change-over valve $V_{13}$, are aired, so that the corresponding change-over valves take up their original positions, as shown. Furthermore, through $V_6$ pressure is passed to a pneumatically operated electric switch $V_{27}$, by which an electric current is switched on for the start of an adjustable timer $T_1$ which after the expiration of the adjusted period, for instance after 5–30 minutes, by means of an electric impulse activates the change-over valve $V_{14}$ causing a compressed air impulse to pass through $V_{17}$ to the change-over valve $V_4$. This valve thereby moves to the position shown so that flap A will close, corresponding to position 3. When flap A is in closed position valve $V_7$ is activated and allows air to flow from the main line through valve $V_6$ — now in position opposite the position shown — through $V_7$ to a pneumatically operated electric switch $V_{28}$ to close a current through this switch. The current, however, will not flow before the conveyor bucket is in receiving position under the slag sluice, where it causes the closing of an electric switch, inserted in a series with $V_{28}$. When the current flows through $V_{28}$, an adjustable timer $T_4$ is started which immediately sends current to a magnet valve $V_{29}$. This valve opens for the increased water supply to the nozzles 15 in the sluice chamber. After the adjusted period has expired, for instance after 1 to 300 seconds, $T_4$ switches off the current to $V_{29}$ which in its turn shuts off the increased supply of water and activates an electrically operated, spring-loaded change-over valve $V_{11}$. Thereby a compressed air impulse passes through $V_{25}$ to the change-over valve $V_5$ which changes over to opening of the lower flap B, i.e. position 4.

In this position $V_{10}$ is activated and allows a compressed air impulse through $V_{18}$ and to $V_6$ which changes over to the position shown. By this, a compressed air impulse passes through $V_6$ to the delay air receiver $R_2$ and on to $V_{13}$ which for instance with a delay of 30 seconds is activated and permits a compressed air impulse to pass on to $V_{19}$ and on to the change-over valve $V_5$ which changes over to the position shown, i.e. closing the lower flap B. By this, $V_9$ is activated, and the cycle described starts again.

After the contents of the sluice chamber have been emptied into the transport bucket, and the lower flap B has been closed, the skip hoist is started, an electric switch K being closed by the closing of B, activating a relay U which reacts only at the moment when K closes the current, and which by its activation starts an adjustable timer $T_5$. After the adjusted period has elapsed, for instance after maximum 30 seconds, $T_5$ will start the skip hoist.

In case the moving cycle of the sluice flaps for some reason or other is stopped, an alarm will go off after a certain time when an adjustable timer $T_2$ runs out. The latter will, however, normally, automatically be adjusted to its zero position before the adjustment period expires, as described below, to start its period afresh.

At the expiration of its period of adjustment, the timer $T_1$ starts an adjustable impulse relay $T_3$ which after say 1 to 180 seconds puts the running alarm clock $T_2$ back in its zero-position and restarts it. In case this zero-impulse fails to come through, $T_2$ — after the expiration of its adjustment period, such as 2 to 60 minutes — activates an alarm S through a pneumatic electric switch $V_{26}$ which is constantly switched on by means of the air pressure in the system's network. By adjusting the change-over valve $V_1$ to manual operation, the pressure in the line is abolished and $V_{26}$ is cut off, whereby the alarm is disengaged.

In case of priming, the priming thermostat of the boiler activates a spring-loaded change-over valve $V_{16}$ and a compressed air impulse passes through the latter and the non-return valves $V_{24}$ and $V_{25}$ respectively to the change-over valves $V_4$ and $V_5$ which thus change over to opening of both sluice flaps A and B.

By the switch-over to manual operation, the change-over valve $V_1$ is changed over from the position shown in the drawing to its other position. Hereby the main power net $L_1$ is cut off from connection with the feed line L and is aired, whereby the spring-loaded valve $V_{15}$ changes over from the position shown as it goes back to its original position by means of its restoration spring. By this, a compressed air impulse passes through the change-over valves $V_{17}$ and $V_{19}$ respectively to each of the change-over valves $V_4$ and $V_5$ which take up positions corresponding to the closing of the sluice flaps A and B, and furthermore a compressed air impulse passes through $V_{18}$ and $V_6$ which takes up positions as shown, whereby $V_{17}$ is aired and the contact is broken. By switching over to the automatics again, the system will thus start in position 1.

When $V_1$ is adjusted for manual operation, opening and closing of the sluice flaps A and B follow by manual operation of the valves $V_2$ and $V_3$ for A and B respectively. These valves can from the neutral position shown be changed over to one or another of the two active positions in which they— through a network not shown — establish direct contact between the feed line L and one end or other of the cylinders A and B respectively, as indicated by the letters *x* and *y* respectively z and u.

By adjustment to manual operation when the pressure in the network $L_1$ disappears, the switch $V_{26}$ will— as mentioned earlier — be disconnected so that the alarm S is not released even if the alarm clock $T_2$ is still running. Also the valve $V_{16}$, which is activated by priming, remains inactive.

Instead of a single working cylinder, two parallel working cylinders may be in play for each sluice flap.

What we claim is:

1. An apparatus for removing burnt material such as clinker or uncombusted residual material and the like from a combustion furnace having means communicating with the furnace for discharging said material which comprises:

a. a duct attached to the discharge means and having a cross-section at least equal to that of the discharge means, said duct defining a sluice chamber therewithin and being oriented in a generally downward direction relative to a horizontal plane;

b. and upper flap rotatably mounted with respect to the upper end portion of the duct and having a first open position which exposes substantially the full cross-section of the duct to the discharge means and a second closed position in which the flap defines an upper wall portion of said sluice chamber;

c. a second flap rotatably mounted with respect to the lower end portion of the duct and having a first open position which exposes substantially the full cross-section of the lower portion of the duct and a second closed position in which said second flap defines the lower wall of said sluice chamber; and d. at least one nozzle mounted in a side wall of said duct between said upper and lower flaps and connected to a liquid supply means and capable of introducting a liquid into the sluice chamber at least at introducing minimum rate at least sufficient to contain dust in the sluice chamber and to maintain the nozzle in a relatively dust free condition at least when the lower flap is in a closed position and the upper flap is in an open position and material from the furnace is permitted to enter the sluice chamber, said nozzle and liquid supply means being capable of introducing said liquid at a relatively increased rate sufficient to cool material accumulated within the sluice chamber at least when the upper and lower flaps are in closed positions, said flaps being selectively rotatable to said opened and closed positions such that simultaneously maintaining the lower flap in a closed position and the upper flap in an open position permits material discharged from the furnace to accumulate to a predetermined level within the sluice chamber while said liquid is introduced into the sluice chamber at least at said minimum rate and closing the upper flap while maintaining the lower flap in said closed position while introducing said liquid into said sluice chamber at said relatively increased rate provides cooling of the material accumulated therein and selectively opening the lower flap causes discharge of the material accumulated within the sluice chamber.

2. The apparatus according to claim 1 further comprising means for receiving material discharged from said sluice chamber, said receiving means capable of being selectively positioned below the lower flap such that when the lower flap is rotated to said open position and the material discharges into said receiving means.

3. The apparatus according to claim 2 wherein said duct is oriented in a downward and sloping direction with respect to a vertical plane so as to define a slanted sluice chamber therewithin.

4. The apparatus according to claim 3 further comprising a plurality of said nozzles positioned in the sidewalls of said duct, said nozzles and said liquid supply means being adapted to introduce water into said sluice chamber and said material receiving means comprises a transport bucket having means for selectively transporting the bucket to said position beneath said lower flap of said sluice chamber and for removing the bucket to transport material therein away from the sluice chamber.

5. The apparatus according to claim 4 wherein said discharge means communicating with the furnace for discharging material into the sluice chamber comprises a shaft connected to the discharge end portion of the furnace and to a duct having a knee-bend configuration defining an ash pit which accumulates material when the upper flap is in a closed position, said knee-bend duct communicating with said sluice chamber.

6. The apparatus according to claim 5 wherein said upper and lower flaps are capable of being selectively and simultaneously rotated to an open position to permit the flow of air to the furnace through said sluice chamber to said ash pit.

7. The apparatus according to claim 2 having means for selectively controlling said flaps which comprises:

a. a double-acting pneumatically operated cylinder operatively connected to each flap to produce rotation of each flap from a closed to an open position and from an open to a closed position;

b. a supply of compressed air to actuate said cylinders;

c. pneumatically adjustable valve means associated with each pneumatic cylinder to selectively control the introduction of compressed air to each cylinder as required to produce selective rotation of said flaps;

d. a plurality of air pilot valve means operatively connected to selectively control the flow of compressed air to each cylinder in accordance with a predetermined sequence and to control the flow of liquid through said nozzles to said sluice chamber;

e. valve means positioned and activated in accordance with the position of each flap to control the flow of compressed air to said air pilot valve means; and f. electrical relay means capable of producing signals in relation to the position of at least one of said flaps and said material receiving means to control the flow of compressed air through said air pilot valve means and to said cylinders.

8. The apparatus according to claim 4 having means for selectively controlling the flaps which comprises:

a. means for providing motive power to said flaps for rotating said flaps to their open and closed positions;

b. pneumatic means for selectively controlling the motive power to each flap for selectively closing and opening said flap in accordance with a predetermined sequence;

c. a pilot system for selectively automatically or manually controlling said flaps and said water supply and said transport bucket in time relation to selectively fill and sluice chamber to a predetermined level while introducing water into said sluice chamber at a minimum rate sufficient to contain dust and to maintain said nozzles in a relatively dust free condition and for thereafter increasing the rate of introduction of water sufficient to cool the material in said sluice chamber and for transferring said material from said sluice chamber to said transport bucket and for transporting said bucket from said sluice chamber, said pilot system further having means to control the rotational movement of said flaps in timed relation to a signal produced when said transport bucket is in a material receiving position.

9. The apparatus according to claim 4 having a pilot system for selectively controlling the flaps which comprises:

a. means for providing motive power to said flaps for rotating said flaps to their respective open and closed positions;

b. means for selectively controlling the motive power to each flap rotating means for selectively closing and opening said flaps;

c. signal emitting means capable of producing at least one signal to control the direction of power from said power control means to said flaps;

d. at least one signal emitting means associated with said transport bucket and adapted to emit a signal when said transport bucket is in its material receiving position beneath said sluice chamber;

e. electrical switching means positioned and adapted to be actuated by said flaps in their open and closed positions and controlled by said signal emitting means associated with said transport bucket in its receiving position; and f. at least one time relay activated by said signal emitting means associated with said transport bucket to selectively direct power as required for opening and closing said flaps and for activating said water supply to said sluice chamber.

10. The apparatus according to claim 9 further comprising means to direct power to said flap rotating power means in a manner which produces rotation of both flaps to their open positions in response to abnormal conditions in the furnace requiring ventilation of said furnace.

11. The apparatus according to claim 10 further comprising an alarm mechanism capable of emitting an alarm in response to abnormal conditions within the pilot system.

12. The apparatus according to claim 4 having means for controlling said flaps which comprises:

a. a double-acting pneumatically operated cylinder operatively associated with each flap to produce rotation of said flaps by movement in at least one of two directions;

b. first change-over valves associated with each flap and operatively connected to control compressed air from a feed line to each respective cylinder;

c. second change-over valves adapted to be activated when said flaps are rotated to their closed positions;

d. third change-over valves mounted respectively to be activated when said flaps are rotated to their open positions, said third change-over valves thus activated, being adapted to complete a connection between a compressed air feed line and a discharge line, said second and third change-over valves having an inactive position which blocks the feed line and airs the discharge line;

e. said flaps being mounted such that when they are rotated to a closed position, activate the second change-over valves while the compressed air feed line to at least one of said second change-over valves is aired through a primary change-over valve communicable with said compressed air feed line and adjustable to a position to direct a compressed air impulse through at least one of said second change-over valve associated with said lower flap when said lower flap is in a closed position;

f. a compressed air accumulating means associated with said upper flap and adapted to activate an associated third change-over valve, said third change-over valve being activatable to a position which permits compressed air impulses through a non-return valve to change-over said first change-over valve associated with said upper flap to rotate said upper flap to its open position and to activate said associated third change-over valve, said associated third change-over being adapted to direct a compressed air impulse to said primary change-over valve, said primary change-over valve thereby airing said accumulating means associated with said upper flap at least partially through the activation of said second change-over valve associated with said lower flap in a closed position whereby the change-over valve associated with said accumulating means is activated to its inactive position and simultaneously permits a compressed air impulse to be directed to a pneumatically operated electrical switching means, said switching means being connected to activate a timing means, said timing means being capable of delaying activation of a fourth change-over valve, said fourth change-over valve being capable of directing a compressed air impulse through a fifth change-over valve adapted to change-over said first change-over valve associated with said upper flap to actuate the associated pneumatic cylinder to rotate the upper flap to a closed position, and activating said second change-over valve associated with said upper flap permits a compressed air impulse through said primary change-over valve and said second change-over valve asociated with said upper flap to close a pneumatically operated electrical switching means, which in turn activates an adjustable timing means for controlling said cooling water to said sluice chamber and to delay the change-over of said first change-over valve associated with said lower flap to delay opening of said lower flap; and g. said first change-over valve associated with said lower flap being activated to direct compressed air to the pneumatic cylinder associated with said lower flap to rotate said lower flap to its open position whereby said lower flap activates said third change-over valve associated with said lower flap to direct a compressed air impulse through a fifth change-over valve, said fifth change-over valve being adapted to change-over the primary change-over valve whereby a compressed air impulse is directed through said primary change-over valve and through at least one accumulating means associated with said lower flap to produce delayed activation of a change-over valve associated with said lower flap air accumulating means to direct a compressed air impulse through said non-return valve associated with said lower flap to produce rotation of said lower flap to the closed position.

13. The apparatus according to claim 12 wherein said circuit for delaying the opening of said lower flap is activated by said pneumatically operated electrical switching means and deactivated by an electrical switch positioned to be switched to its off position by said transport bucket in its material receiving position beneath said lower flap thereby deactivating said delaying circuit, and an electrical switching means is positioned to be activated to its active position by the closing movement of said lower flap, said last mentioned electrical switching means being connected to an electrical relay adapted to simultaneously activate an adjustable timing means when said electrical switch is deactivated by said transport bucket, said timing means being adapted to initiate movement of said transport bucket away from the sluice chamber upon expiration of a predetermined time period said predetermined time period being sufficient to permit a full cycle of the sluice operation.

14. The apparatus according to claim 13 further comprising a priming thermometer associated with the boiler of said furnace and a spring biased change-over valve adapted to be activated by a signal from said priming thermometer to permit a compressed air impulse to pass through said non-return valves to change-over said first change-over valves associated with said flaps for opening said flaps.

15. The apparatus according to claim 14 further comprising an alarm device, a continuously operating second timer adapted to automatically return to its start position upon receiving an electrical impulse from said first timer through said pneumatically operated electrical switching means associated with said upper flap, said alarm device being adapted to be electrically activated at the expiration of the time period set for said second timer, said last mentioned pneumatically operated electrical switching means being activated by said primary change-over valve by the movement of said upper flap to its open position, and an electrical connection between said second timer and alarm device being completed by a pneumatically operated electrical switch in the compressed air line.

16. The apparatus according to claim 15 further comprising a manually operated change-over valve to produce a change-over from automatic to manual operation of said sluice flaps, said valve being adapted to complete a connection between a direct feed line and a main supply line of said compressed air supply, a spring-biased change-over valve connected to said main supply line and maintained in a first position by the pressure of compressed air in said feed line whereby the connection to the main line is blocked, said manually operated change-over valve having a second position which blocks the connection between the main supply line and direct feed line and airs the feed line whereby said spring-biased valve, through its spring action, changes over to a position which completes a connection between the main supply line and said first change-over valves associated with said flaps, said change-over valves being thereby maintained in positions corresponding to closed flaps, two manually operated change-over valves each having neutral positions and two active positions, one active position allowing compressed air to one end of the corresponding flap pneumatic air cylinder while airing the other end, and the other active position allowing air to the other corresponding flap pneumatic air cylinder while airing the other end thereof.

17. An apparatus for removing burnt materials such as cement clinker from a furnace such as a rotary kiln or uncombusted residual materials and the like from a furnace such as a rotary kiln, said furnace having an ash pit defined by a shaft which communicates with an appropriate discharge end portion and a conduit communicating with the shaft for discharging said material from the furnace which comprises:

a. a duct having a substantially rectangular cross-section connected to said shaft and having a cross-section approximately equal to that of the ash pit and attached to the lower end portion thereof, said duct being oriented in a generally slanted and downward direction relative to vertical and horizontal planes, said duct having an internal lining formed for relatively wear-resistant plates which define a sluice chamber therewithin;

b. a first flap rotatably mounted to the upper end portion of the duct and having a first open position which exposes substantially the full cross-section of the duct to the ash pit communicable therewith, and a second closed position which substantially seals the upper end portion of the duct and defines an upper wall portion of a sluice chamber defined within said duct;

c. a second flap rotatably mounted with respect to the lower end portion of a duct and having a first open position which exposes substantially the full cross-section of the lower end portion of the duct so as to permit discharge of material accumulated within a sluice chamber and a second closed position which substantially seals the lower end portion and defines the lower wall of said sluice chamber within said duct;

d. water nozzles positioned in the side walls of said duct between said upper and lower flap and connected to a water supply means and capable of continuously introducing water into the sluice chamber at a minimum rate at least sufficient to contain dust in the sluice chamber and to maintain said nozzles in a relatively dust free condition at least when the lower flap is in a closed position and the upper flap is in an open position and material from the ash pit is permitted to enter the sluice chamber, said nozzles and water supply means further being capable of introducing water into said sluice chamber at a relatively increased rate sufficient to cool material accumulating therewithin at least when the upper and lower flaps are in closed positions;

e. pneumatically operated actuating means connected to each flap, said actuating means being operatively connected by an electrical-pneumatic control system to selectively open and close said flaps so as to rotate the lower flap to its closed position and the upper flap to its open position so as to permit material discharged from the furnace to accumulate up to a predetermined level within the sluice chamber while said nozzles introduce water into said sluice chamber at a rate at least sufficient to contain dust therein and to maintain the nozzles in a relatively dust free condition, said pneumatic system and actuating means being capable of closing the upper flap while maintaining the lower flap in a closed position while said nozzles introduce water into said sluice chamber at said relatively increased rate to provide cooling of the material accumulated therein, said pneumatic system and actuating means further being capable of opening the lower flap to cause discharge of the material accumulated within the sluice chamber; and f. a transport bucket capable of being selectively positioned beneath the lower flap for receiving material discharged from the sluice chamber and means operatively associated with said transport bucket to delay opening of the lower flap for a predetermined time period corresponding to a full cycle of the sluicing operation and means for transporting said bucket from said sluice chamber to another location when it at least partially filled to a predetermined level.

18. A method for operating a sluice system for removing hot material such as cement clinker from a furnace such as a rotary kiln or uncombusted or slag material and the like from a furnace through an ash pit communicating with a discharge opening of the furnace and having a steel plate duct having a cross-section at least equal to the cross-section of the ash pit, said duct being connected to the ash pit and positioned in a downward, relatively steeply slanted position, an upper rotatably mounted flap having an open position exposing substantially the full cross-section of the duct to the ash pit and a closed position at least substantially sealing communication between the duct and the ash pit and defining the upper wall of a sluicing chamber within the duct, a lower rotatably mounted flap having an open position exposing substantially the full cross-section of the lower end portion of the duct and having a closed position at least substantially sealing the lower end portion of the sluicing chamber within said duct and defining the lower wall of said sluicing chamber, nozzle means mounted in the side wall of the duct between said upper and lower flaps and connected to a water supply means and adapted for introducing water into said sluicing chamber defined within said duct comprising:

a. positioning a material receiving means in a material receiving position below the discharge end portion of the sluicing chamber;

b. closing the lower flap and opening the upper flap for a time period sufficient to permit a predetermined amount of said material from the ash pit to enter the sluicing chamber while simultaneously introducing water through said nozzle means and into said sluicing chamber at least at a minimum level sufficient to contain dust and to maintain the nozzle means in a dust free condition;

c. closing the upper flap and introducing water through said nozzle means at a rate greater than the rate of introduction of water utilized to contain the dust in the sluice chamber and sufficient to further cool the hot material in said sluicing chamber;

d. discontinuing the introduction of cooling water at said greater rate; and e. opening the lower flap while simultaneously permitting the relatively cooled material to be discharged from the sluicing chamber into the material receiving means.

19. The method according to claim 18 further comprising reducing said rate of introduction of water into said sluicing chamber to said minimum level sufficient to contain dust and to maintain said nozzle in a dust free condition when said upper and lower flaps are in a closed position and a predetermined amount of water has been introduced into said sluicing chamber at said greater rate and said material is cooled sufficiently prior to discharge thereof from said sluicing chamber.

20. The method according to claim 19 further comprising positioning a transport bucket below the material discharge end of said sluicing chamber, closing the lower flap when said bucket is filled with discharge material to a predetermined level and thereafter removing the bucket away from its position below the sluicing chamber to transport the relatively cooled material therefrom.

* * * * *

UNITED STATES PATENT AND TRADEMARK OFFICE

CERTIFICATE OF CORRECTION

PATENT NO. : 3,933,103

DATED : January 20, 1976

INVENTOR(S) : Verner Johannes Mikkelsen

It is certified that error appears in the above-identified patent and that said Letters Patent are hereby corrected as shown below:

In Col. 1, line 28, "store which" should read -- store from which --.

In Col. 1, line 39, "discharge" should read -- discharged --.

In Col. 1, line 65, "is common" should read -- is a common --.

In Col. 5, line 31, "flat A" should read --flap A --.

In Col. 5, line 50, "flat A" should read --flap A --.

In Col. 5, line 52, "line" should read -- lines --.

In Col. 6, line 65, "passed" should read -- passes --.

In Col. 8, line 37, "takes" should read -- take --.

In Col. 9, line 3, "and" should read -- an --.

In Col. 9, line 20, "at introducing minimum" should read -- at a minimum --.

In Col. 9, line 50, cancel the word "and".

In Col. 12, line 2, "change-over being" should read -- change-over valve being --.

In Co. 13, line 66, "for" should read -- of --.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*